United States Patent [19]

Tsubuko et al.

[11] 4,060,493

[45] Nov. 29, 1977

[54] LIQUID ELECTROSTATIC DEVELOPER

[75] Inventors: Kazuo Tsubuko, Yokohama; Taro Kimura, Tokyo; Junichiro Hashimoto, Tokyo; Tsuneo Kurotori, Tokyo, all of Japan

[73] Assignee: Ricoh Co., Ltd., Tokyo, Japan

[21] Appl. No.: 594,806

[22] Filed: July 10, 1975

[51] Int. Cl.[2] ..... G03G 9/12

[52] U.S. Cl. ..... 252/62.1 L; 96/1 LY; 260/28.5 R; 260/836; 260/885; 427/15; 427/17; 526/12

[58] Field of Search ..... 252/62.1 L, 62.1 R; 260/28.5 R, 836, 885; 96/1 LY; 526/12; 427/15, 17

[56] References Cited

U.S. PATENT DOCUMENTS

| | | | |
|---|---|---|---|
| 2,891,911 | 6/1959 | Mayer | 252/62.1 L |
| 3,105,821 | 10/1963 | Johnson | 252/62.1 L |
| 3,585,140 | 6/1971 | Machida et al. | 252/62.1 L |
| 3,623,986 | 11/1971 | Machida et al. | 252/62.1 L |
| 3,639,244 | 2/1972 | Machida et al. | 252/62.1 L |
| 3,657,130 | 4/1972 | Machida et al. | 252/62.1 L |
| 3,900,412 | 8/1975 | Kosel | 252/62.1 L |

*Primary Examiner*—Mayer Weinblatt
*Assistant Examiner*—John D. Smith
*Attorney, Agent, or Firm*—Blanchard, Flynn, Thiel, Boutell & Tanis

[57] ABSTRACT

Liquid electrostatic developer having pigment or dyestuff dispersed in a non-aqueous dispersion containing a graftcopolymer and at least one substance selected from the group consisting of polyethylene, polyethylene wax and paraffin wax in a liquid carrier having a high resistivity and a low dielectric constant.

4 Claims, No Drawings

LIQUID ELECTROSTATIC DEVELOPER

BACKGROUND OF THE INVENTION

There is well known a liquid developer for electrostatic latent images comprising a mixture of pigment and alkyd resin dispersed in a liquid carrier such as paraffinic hydrocarbon. In this developer, a dyestuff may be used instead of a pigment, and acrylic resin, rosin or synthetic rubber also may be used instead of alkyd resin. Further, a small amount of lecithin, linseed oil, higher fatty acid or metallic soap may be added to the liquid developer for controlling a polarity of the liquid carrier. However, such a conventional liquid developer has low dispersability of pigment or dyestuff, and gives deposits after prolonged storage or by repeated use so that its developing power is remarkably reduced.

It is an object of the present invention to provide an improved liquid developer for electrostatic latent image.

SUMMARY OF THE INVENTION

The present invention relates to a liquid electrostatic developer (a liquid developer for electrostatic latent images) having pigment or dyestuff dispersed in a non-aqueous dispersion containing a graftcopolymer and at least one substance selected from the group consisting of polyethylene, polyethylene wax and paraffin wax in a liquid carrier having a high resistivity and a low dielectric constant.

The liquid electrostatic developer of this invention can be obtained by dispersing pigment or dyestuff in a non-aqueous dispersion which has been prepared by (1) carrying out successively the following three steps (a), (b) and (c) in a liquid carrier such as aliphatic hydrocarbon or halogenated aliphatic hydrocarbon at an elevated temperature, (2) adding polyethylene, polyethylene wax or paraffin wax having a softening point of 60° C to 130° C in one of the three steps and (3) then cooling the reaction product while stirring vigorously:

a. copolymerizing a monomer having the general formula (I):

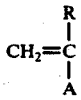

(I)

(wherein R is hydrogen or methyl group, and A is —$COOC_nH_{2n+1}$ or —$OC_nH_{2n+1}$, $n$ being an integer of 6 to 20) with at least one compound selected from the group consisting of acrylic acid, methacrylic acid, fumaric acid, crotonic acid, itaconic acid, maleic acid, glycidyl acrylate and glycidyl methacrylate, b. esterifying the copolymer obtained in the above step (a) with glycidyl acrylate or glycidyl methacrylate when said copolymer has been prepared by using acrylic acid, methacrylic acid, fumaric acid, crotonic acid, itaconic acid or maleic acid, or esterifying the copolymer obtained in the above step (a) with acrylic acid, methacrylic acid, fumaric acid, crotonic acid, itaconic acid or maleic acid when said copolymer has been prepared by using glycidyl acrylate or glycidyl methacrylate, and then c. grafting the esterified copolymer obtained in the above step (b) with a monomer having a vinyl group selected from the group consisting of acrylic acid, methacrylic acid, a lower alkyl ester of acrylic acid or methacrylic acid, styrene, methylstyrene and vinyl acetate.

The features of the liquid developer of the present invention are as follows:

1. The developer has high dispersability of pigment or dyestuff and is stable even after prolonged storage such as 8 months.

2. The developer can give a vivid image of high density.

3. The developer is suitable for preparing a copy to be used as a master for offset printing, because the graft-copolymer, polyethylene, polyethylene wax and paraffin wax are all hydrophobic.

4. The image formed on a photoconductor by using the developer of this invention can easily be transferred to a substrate such as paper by pressure, or electrostatic or magnetic force.

Accordingly, the liquid developers of this invention are useful to develop an electrostatic latent image in the Electrofax process. The Electrofax process involves the following three steps in making a print:

1. Sensitizing the photoconductive layer on a support by electrical charging, the photoconductive layer consisting essentially of a mixture of photoconductive zinc oxide and a binder.

2. Exposing the photoconductive layer to form an electrostatic latent image.

3. Developing the latent image with fine particles, called the toner, dispersed in a liquid carrier having a high resistivity and a low dielectric constant.

The process of preparing a non-aqueous dispersion for use in preparing a liquid electrostatic developer of this invention will be illustrated in detail below:

The reaction of the step (a) is carried out by heating a mixture of a monomer of the formula (I) and one compound selected from the group consisting of acrylic acid, methacrylic acid, fumaric acid, crotonic acid, itaconic acid, maleic acid, glydicyl acrylate and glycidyl methacrylate in a ratio of 99.9–80 to 0.1–20 parts by weight at a temperature of 70° C to 150° C in an aliphatic hydrocarbon. Typical monomers of the formula (I) include lauryl, 2-ethylhexyl, stearyl or vinylstearyl acrylates and methacryltes.

The reaction of the step (b) is carried out by adding a monomer as mentioned above to the reaction mixture obtained in the step (a) and heating the mixture at a temperature of 30° C to 120° C, in the presence of a catalyst such as pyridine or lauryldimethylamine. Said monomer is used in an amount of 0.1–20 parts based on 100 parts by weight of the copolymer obtained in the step (a).

The reaction of the step (c) is carried out by adding a monomer as mentioned above to the reaction mixture obtained in the step (b) and heating the mixture at a temperature of 70° C to 150° C in the presence of a catalyst such as benzoyl peroxide or 2,2'-azobisisobutyronitrile. Said monomer is used in an amount of 5–100 parts based on 100 parts by weight of the esterified copolymer obtained in the step (b). The lower alkyl ester of acrylic acid or methacrylic acid used in this step (c) is methyl, ethyl, propyl or butyl acrylate or methacrylate.

In the way mentioned above, a mixture containing graftcopolymers can be obtained.

In one of the three steps (a), (b) and (c), a solution of polyethylene, polyethylene wax or paraffin wax in an organic solvent is added to the reaction mixture.

Polyethylene, polyethylene wax and paraffin wax hving a softening point of 60° C to 130° C are used in an amount of 1–50 parts based on 100 parts by weight of the graftcopolymer. Preferred organic solvents for dissolving polyethylene, polyethylene wax or paraffin wax are as follows:

Aliphatic hydrocarbons such as n-pentane, n-hexane and isooctane, aliphatic hydrocarbons sold by Esso-Standard Oil Co. under the trademark of Isopar H, G, L or K, carbon tetrachloride and tetrachloroethylene.

Polyethylene, polyethylene wax and paraffin wax having a softening point of 60° C to 130° C are commercially available. Manufacturers, trademarks and softening points are listed below:

| | Manufacturer | Trademark | Softening point (° C) |
|---|---|---|---|
| (1) | Polyethylene | | |
| | Union Carbide Corp. | DYNF | 102 |
| | | DYNH | 102 |
| | | DYNI | 102 |
| | | DYNJ | 102 |
| | | DYNK | 102 |
| | Du Pont Co. Inc. | Alathon-3 | 103 |
| | | Alathon-10 | 96 |
| | | Alathon-12 | 84 |
| | | Alathon-14 | 80 |
| | | Alathon-18 | 95 |
| | | Alathon-20 | 86 |
| | | Alathon-22 | 84 |
| | | Alathon-25 | 96 |
| | Monsanto Co. | Orizon-805 | 116 |
| | | Orizon-705 | 116 |
| | | Orizon-50 | 126 |
| | Philips Electronics Industrial Corp. | Marlex 1005 | 92 |
| (2) | Polyethylene wax | | |
| | Sanyo Kasei Kagaku-kogyo K.K. | Sanwax-131P | 108 |
| | | Sanwax-151P | 107 |
| | | Sanwax-161P | 111 |
| | | Sanwax-165P | 107 |
| | | Sanwax-171P | 105 |
| | | Sanwax-E200 | 95 |
| (3) | Paraffin wax | | |
| | Junsei Yakuhin K.K. | Paraffin Wax | 60–95 |

By cooling the reaction mixture containing the graftcopolymer and at least one substance selected from the group consisting of polyethylene, polyethylene wax and paraffin wax having a temperature of 70° C to 150° C to room temperature while stirring vigorously, a non-aqueous dispersion of the present invention can be obtained.

Non-aqueous dispersions of this invention are useful as a binder of paint or varnish (coating material), a binder for forming a recording layer of electrostatographic material, or a liquid dispersion medium for preparing an liquid developer for electrostatic latent image.

Preferred embodiments of processes for preparing the non-aqueous dispersion are given below:

Preparation 1

In a vessel equipped with a thermometer, a stirrer and a reflux condenser, 300g of Isopar H was heated to a temperature of 95° C. To this heated Isopar H was added dropwise with stirring over about 3 hours a mixture of 200g of 2-ethylhexyl methacrylate, 10g of glycidyl methacrylate and 3g of 2,2'-azobisisobutyronitrile, and then the stirring was continued for about 1 hour at a temperature of 95° C to produce a copolymer. To this reaction mixture was added a mixture of 5g of acrylic acid, 0.1g of hydroquinone and 1g of lauryldimethylamine, and the reaction mixture was stirred for about 15 hours at a temperature of 90° C to esterify the copolymer. The degree of esterification was about 30%. To the reaction mixture thus esterified was added 500g of Isopar G, and then a mixture of 50g of methyl methacrylate and 3g of 2,2'-azobisisobutyronitrile was added dropwise with stirring over about 3 hours at a temperature of 90° C, and further this mixture was stirred for about 5 hours at a temperature of 90° C to produce a graftcopolymer. To 300g of the reaction mixture thus obtained was added 300g of Isopar G, and then the mixture was heated to a temperature of 90° C and 50g of polyethylene (trademark; Orizon 50) was added. The mixture was heated for about 1 hour at a temperature of 90° C with stirring to obtain a clear liquid. This clear liquid was cooled with cold water, while stirring vigorously, to prepare a non-aqueous dispersion A. The solid content of the dispersion was 17.4%.

PREPARATION 2

In a vessel similar to that used in Preparation 1, 400g of isooctane was heated to a temperature of 95° C. To this heated isooctane was added dropwise with stirring over about 1 hour a mixture of 200g of stearyl methacrylate, 10g of glycidyl acrylate and 2g of benzoyl peroxide, and then the stirring was continued for about 3 hours at a temperature 95° C to produce a copolymer. To this reaction mixture was added a mixture of 1g of lauryldimethylamine, 3g of methacrylic acid and 0.1g of hydroquinone, and the reaction mixture was stirred for about 10 hours at a temperature of 95° C to esterify the copolymer. The degree of esterification was about 30%. To this reaction mixture thus esterified was added 600g of isooctane, and then a mixture of 60g of styrene and 4g of benzoyl peroxide was added dropwise with stirring over about 3 hours at a temperature of 95° C and further this mixture was stirred for about 5 hours at a temperature of 95° C to produce a graftcopolymer. To 200g of this reaction mixture was added 200g of isooctane, and then the mixture was heated to a temperature of 95° C and 50g of polyethylene (trademark; DYNI) was added. The mixture was heated for about 40 minutes at a temperature of 95° C with stirring to obtain a clear liquid. This clear liquid was cooled by the same manner as that in Preparation 1 to prepare a non-aqueous dispersion B. the solid content of the dispersion was 18.8%.

PREPARATION 3

In a vessel similar to that used in Preparation 1, 400g of Isopar L was heated to a temperature of 90° C. To this heated Isopar L was added dropwise with stirring over about 2 hours a mixture of 200g of lauryl methacrylate, 3g of crotonic acid and 1g of benzoyl peroxide, and then the stirring was continued for about 3 hours at a temperature of 95° C to produce a copolymer. To this reaction mixture was added a mixture of 1g of lauryldimethylamine and 10g of glycidyl methacrylate, and the reaction mixture was stirred for about 20 hours at a temperature of 90° C to esterify the copolymer. The degree of esterification was about 50%. To this reaction mixture was added 600g of Isopar L, and then a mixture of 400 g of ethyl acrylate and 4g of benzoyl peroxide was added dropwise with stirring over about 3 hours at a temperature of 90° C and further this mixture was stirred for about 5 hours at a temperature of 90° C to produce a graftcopolymer. To 200g of this reaction mixture was added 200g of Isopar L, and then the mixture was heated to a temperature of 90° C and 20g of polyethylene (trademark; DYNH) was added. The mixture was heated for about 1 hour at a temperature of 95° C with stirring to obtain a clear liquid. This clear liquid was cooled by the same manner as that in Preparation 1 to prepare a non-aqueous dispersion C. The solid content of the dispersion was 12.3%.

PREPARATION 4

In a vessel similar to that used in Preparation 1, 400g of Isopar H was heated to a temperature of 85° C. To this heated Isopar H was added dropwise with stirring over 2 hours a mixture of 200g of 2-ethylhexyl methacrylate, 5g of methacrylic acid and 3g of 2,2'-azobisisobutyronitrile, and then the stirring was continued for about 2 hours at a temperature of 85° C to produce a copolymer. To this reaction mixture was added a mixture of 1g of lauryldimethylamine and 5g of glycidyl acrylate, and the reaction mixture was stirred for about 18 hours at a temperature of 85° C to esterify the copolymer. The degree of esterification was about 50%. To this reaction mixture was added 400g of Isopar H, and then a mixture of 30g of vinyl acetate and 3g of 2,2'-azobisisobutyronitrile was added dropwise with stirring over about 3 hours at a temperature of 90° C and further this mixture was stirred for about 5 hours at a temperature of 90° C to produce a graftcopolymer. To 200g of this reaction mixture was added 200g of Isopar H, and then the mixture was heated to a temperature of 85° C and 20g of polyethylene (trademark; Alathon) was added. The mixture was heated for about 1 hour at a temperature of 85° C with stirring to obtain a clear liquid. This clear liquid was cooled by the same manner as that in Preparation 1 to prepare a non-aqueous dispersion D. The solid content of the dispersion was 13.7%.

PREPARATION 5

In a vessel similar to that used in Preparation 1, 300g of isooctane was heated to a temperature of 90° C. To this heated Isopar H was added dropwise with stirring over 2 hours a mixture of 200g of 2-ethylhexyl methacrylate, 10g of glycidyl methacrylate and 2g of benzoyl peroxide, and then the stirring was continued for about 3 hours at a temperature of 90° C to produce a copolymer. The copolymer was contained in an amount of 40.2% by weight in the reaction mixture. To this reaction mixture was added a mixture of 1g of lauryldimethylamine, 3g of maleic acid and 0.05g of hydroquinone, and the reaction mixture was stirred for about 15 hours at a temperature of 90° C to esterify the copolymer. The acid value of this reaction product was 2.0. To this reaction mixture was added 520g of isooctane, and then a mixture of 40g of methylstyrene and 3g of benzoyl peroxide was added dropwise with stirring over about 3 hours at a temperature of 90° C and further this mixture was stirred for about 5 hours at a temperature of 90° C to a graftcopolymer. To 200g of this reaction mixture was added 200g of isooctane, and then the mixture was heated to a temperature of 90° C and 100g of polyethylene wax (trademark; Sanwax 131P) was added. The mixture was heated for about 1 hour at a temperature of 90° C with stirring to obtain a clear liquid. This clear liquid was cooled by the same manner as that in Preparation 1 to prepare a non-aqueous dispersion E. The solid content of the dispersion was 27.6%.

PREPARATION 6

In a vessel similar to that used in Preparation 1, a mixture of 300g of Isopar H and 50g of polyethylene wax (trademark; Sanwax 171P) was heated to a temperature of 90° C. To this heated mixture was added dropwise with stirring over 5 hours a mixture of 200g of stearyl acrylate, 20g of glycidyl methacrylate and 3g of 2,2'-azobisisobutyronitrile, and then the stirring was continued for about 3 hours at a temperature of 90° C to produce a copolymer. To this reaction mixture was added a mixture of 10g of acrylic acid, 1g of lauryldimethylamine and 0.5g of hydroquinone, and the reaction mixture was stirred for about 10 hours at a temperature of 95° C to esterify the copolymer. To this reaction mixture was added 300g of Isopar H, and then a mixture of 40g of styrene monomer and 3g of 2,2'-azobisisobutyronitrile was added dropwise with stirring over about 3 hours at a temperature of 95° C and further this mixture was stirred for about 5 hours at a temperature of 95° C to produce a graftcopolymer. To 150g of this reaction mixture was added 200g of Isopar H, and then the mixture was heated for about 1 hour at a temperature of 90° C with stirring to obtain a clear liquid. This clear liquid was cooled by the same manner as that in Preparation 1 to prepare a non-aqueous dispersion F. The solid content of dispersion was 14.5%.

PREPARATION 7

A non-aqueous dispersion G was obtained by repeating the same procedure as that of Preparation 6 except that paraffin wax (trademark; Paraffin Wax, softening point 70° – 72° C) was used instead of polyethylene wax. The solid content of dispersion was 13.5%.

Preferred pigments (inorganic and organic) and dyestuff which are used in preparing a liquid developer of this invention are as follows:

Carbon black, Magnetite, Alkali Blue Toner, Phthalocyanine Green, Phthalocyanine Blue, Microlith Blue, Microlith Black, Benzidine Yellow, Brilliant Carmine, Spirit Black, Oil Blue, Oil Violet, Fast Red, Methyl Orange and Methyl Violet.

Liquid carriers which can be used in preparing a liquid developer of this invention are paraffinic hydrocarbons, isoparaffinic or halogenated derivatives thereof having a resistivity of more than $10^9\Omega$.cm and a dielectric constant of less than 3, for example, n-hexane, n-heptane, n-octane, isooctane, carbon tetrachloride, and aliphatic hydrocarbons sold under trademarks of Isopar E, G, H, K, L, Naphtha No. 6 and Solvesso 150.

Liquid electrostatic developers of this invention can be prepared by mixing pigment of dyestuff (0.1 to 10 parts by weight) with a non-aqueous dispersion (1 part by weight) as prepared above in a mixer, for example, a ball mill.

The following examples are given to illustrate preferred embodiments of a liquid electrostatic developer of this invention. The liquid developers were prepared by using Non-aqueous dispersion A, B, C, D, E, F and G as prepared above.

EXAMPLE 1

| | |
|---|---|
| Non-aqueous dispersion A | 50g |
| Carbon Black Mitsubishi #44 (made by Mitsubishi Carbon Co.) | 5g |
| Special black EB (made by Orient Chemical Co.) | 0.5g |

-continued

| | |
|---|---|
| Isopar G | 100g |

The ingredients listed above were mixed in a ball mill for about 40 hours. A liquid developer of this invention was obtained by dispersing 10g of the mixture in 2,000ml of Isopar G. This liquid developer was used in development of Electrofax process and a copy having an image density of 1.3 was obtained. No change in the quality of the developer could be detected due to artificial aging at a temperature of 50° C for 7 days. This developar has high stability.

EXAMPLE 2

| | |
|---|---|
| Non-aqueous dispersion B | 100g |
| Carbon black Mitsubishi #100 | 10g |
| Zinc naphthenate (10% solution in Isopar H) | 0.01g |
| Isopar G | 100g |

A liquid developer was obtained by repeating the same procedure as that of Example 1 except that the ingredients as shown above were used instead of the ingredients of Example 1. By using this liquid developer in the same manner as that of Example 1, a good copy could be obtained. By using this copy as a master of an offset printing, 30,000 sheets of the printed matter having a print density of 1.5 could be obtained. The developer has high stability similar to that of Example 1.

EXAMPLE 3

| | |
|---|---|
| Non-aqueous dispersion C | 25g |
| Benzidine Yellow GX (made by Mitsubishi Kasei K.K.) | 5g |
| Isopar H | 100g |

A yellowish liquid developer was obtained by mixing the ingredients listed above in a ball mill for 60 hours. By using this liquid developer in the Electrofax process in the manner similar to that of Example 1, a copy having a vivid yellowish image could be obtained.

EXAMPLE 4

| | |
|---|---|
| Non-aqueous dispersion D | 25g |
| Microlith Blue (made by Ciba Ltd.) | 5g |
| Isooctane | 100g |

A liquid developer having cyan color was obtained by mixing the ingredients listed above in a ball mill for 60 hours. By using this liquid developer in the Electrofax process in the manner similar to that of Example 1, a copy having a vivid image of cyan color could be obtained.

EXAMPLE 5

| | |
|---|---|
| Non-aqueous dispersion E | 50g |
| Microlith Black CT (made by Ciba Ltd.) | 10g |
| Linseed Oil | 0.1g |
| Isopar H | 100g |

A liquid developer of this invention was prepared by mixing the ingredients listed above in a ball mill for 24 hours and dispersing 14g of the mixture in 4,000ml of Isopar H. This liquid developer was used in development of the Electrofax process and a copy having a vivid image was obtained. The liquid developer has high stability similar to that of Example 1.

EXAMPLE 6

| | |
|---|---|
| Non-aqueous dispersion F | 50g |
| Magnetite ($F_{e3}O_4$) | 10g |
| Isopar g | 100g |

A liquid developer of this invention was prepared by mixing the ingredients listed above in a ball mill for 40 hours. By using this liquid developer in the Electrofax process, a copy having an image was obtained. The image was transferred to paper by overlaying paper on the copy and attracting magnetically magnetite to the paper.

EXAMPLE 7

| | |
|---|---|
| Non-aqueous dispersion A | 10g |
| Non-aqueous dispersion F | 10g |
| Microlith Blue (made by Ciba Ltd.) | 10g |
| Oleic acid | 3g |
| Isopar L | 100g |

A liquid developer of this invention was prepared by mixing the ingredients listed above in a ball mill for 60 hours.

An electrostatic latent image formed on a xerographic plate made of selenium, was developed with the liquid developer, and the developed image was transferred to paper. A copy having a stable image was obtained.

EXAMPLE 8

| | |
|---|---|
| Non-aqueous dispersion G | 10g |
| Carbon black (Mitsubishi Carbon #100) | 5g |
| Isopar G | 100g |

A liquid developer of this invention was prepared by mixing the ingredients listed above in a ball mill for 24 hours and dispersing 10g of the mixture in 2,000ml of Isopar H. By using this liquid developer in development of the Electrofax process, a copy similar to that of Example 1 was obtained.

I claim:

1. A liquid electrostatic developer consisting essentially of pigment or dyestuff blended in a non-aqueous dispersion of a graft copolymer and from one to 50 parts by weight, per 100 parts by weight of said graft copolymer, of at least one substance selected from the group consisting of polyethylene, polyethylene wax and paraffin wax having a softening point of 60° C to 130° C, said graft copolymer and said substance being dispersed in an organic liquid carrier having a high resistivity of more than $10^9\Omega$.cm and a low dielectric constant of less than 3, which non-aqueous dispersion has been prepared by carrying out successively the following three steps (a), (b) and (c) in said liquid carrier at an elevated temperature, adding said substance in one of the three steps and then cooling the reaction product of step (c) containing said substance while stirring vigorously:

a. copolymerizing from 99.9 to 80 parts by weight of a monomer having the formula (I):

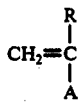

(I)

, wherein R is hydrogen of methyl, A is —$COOC_nH_{2n+1}$ or —$OC_nH_{2n+1}$, and $n$ is an integer of 6 to 20, with from 0.1 to 20 parts by weight of at least one compound selected from the group consisting of acrylic acid, methacrylic acid, fumaric acid, crotonic acid, itaconic acid, maleic acid, glycidyl acrylate and glycidyl methacrylate, b. esterifying 100 parts by weight of the copolymer obtained in step (a) with from 0.1 to 20 parts by weight of glycidyl acrylate or glycidyl methacrylate when said copolymer has been prepared by using acrylic acid, methacrylic acid, fumaric acid, crotonic acid, itaconic acid or maleic acid, or esterifying 100 parts by weight of the copolymer obtained in step (a) with from 0.1 to 20 parts by weight of acrylic acid, methacrylic acid, fumaric acid, crotonic acid, itaconic acid or maleic acid when said copolymer has been prepared by using glycidyl acrylate or glycidyl methacrylate, and then c. grafting 100 parts by weight of the esterified copolymer obtained in step (b) with from 5 to 100 parts by weight of a monomer having a vinyl group selected from the group consisting of acrylic acid, methacrylic acid, a lower alkyl ester of acrylic acid or methacrylic acid, styrene, methylstyrene and vinyl acetate.

2. A liquid electrostatic developer as claimed in claim 1 in which said pigment or dyestuff is selected from the group consisting of carbon black, magnetite, alkali blue toner, phthalocyanine green, phthalocyanine blue, microlith blue, microlith black, benzidine yellow, brilliant carmine, spirit black, oil blue, oil violet, fast red, methyl orange and methyl violet.

3. A liquid electrostatic developer as claimed in claim 1 in which from 0.1 to 10 parts by weight of said pigment or dyestuff is blended in one part by weight of said non-aqueous dispersion.

4. A liquid electrostatic developer as claimed in claim 1, in which the reaction product of step (c) at a temperature in the range of from 70° to 150° C and containing said graft copolymer and said substance, wherein said substance is dissolved in said liquid carrier, is cooled to room temperature with vigorous stirring whereby to form said non-aqueous dispersion.

* * * * *